US006951622B2

(12) United States Patent
Chung et al.

(10) Patent No.: US 6,951,622 B2
(45) Date of Patent: Oct. 4, 2005

(54) METHOD FOR FABRICATING AN INTEGRATED NOZZLE PLATE AND MULTI-LEVEL MICRO-FLUIDIC DEVICES FABRICATED

(75) Inventors: Chen-Kuei Chung, Hsinhua (TW); Chun-Jun Lin, Hsinchu (TW)

(73) Assignee: Industrial Technology Research Institute, Chutung (TW)

( * ) Notice: Subject to any disclaimer, the term of this patent is extended or adjusted under 35 U.S.C. 154(b) by 31 days.

(21) Appl. No.: 10/215,143

(22) Filed: Aug. 8, 2002

(65) Prior Publication Data

US 2004/0029305 A1 Feb. 12, 2004

(51) Int. Cl.[7] ..... B41J 2/16

(52) U.S. Cl. ..... 216/27; 216/39; 216/49; 29/890.1; 438/21

(58) Field of Search ..... 216/2, 12, 27, 216/39, 49, 51, 47, 56, 67; 347/20; 29/890.1; 438/21

(56) References Cited

U.S. PATENT DOCUMENTS 5,198,834 A * 3/1993 Childers et al. ..... 347/65
5,308,442 A * 5/1994 Taub et al. ..... 316/27
5,710,583 A * 1/1998 Mitani ..... 347/62
5,831,648 A * 11/1998 Mitani et al. ..... 347/62
6,214,245 B1 * 4/2001 Hawkins et al. ..... 216/27
2002/0012027 A1 * 1/2002 Moon et al. ..... 347/64

* cited by examiner

*Primary Examiner*—Allan Olsen
(74) *Attorney, Agent, or Firm*—Shaw Pittman LLP

(57) ABSTRACT

A method for fabricating a multi-level micro-fluidic device for an micro-fluidic injection head equipped with symmetrical heaters. The method incorporates two thick photoresist deposition processes, a light-absorbing layer deposited in-between and a nickel-containing material electroplating process. The first thick photoresist deposition process is carried out to form a primary ink chamber in fluid communication with a funnel-shaped manifold and an injector orifice. The light-absorbing layer is deposited to prevent overheating of the first photoresist layer during a subsequent metal seed layer sputtering process. The second thick photoresist deposition process forms a mold for forming an injector passageway that leads to the injector orifice. The nickel-containing material electroplating process provides an orifice plate on top of the injection head through which an injector passageway that leads to the injector orifice is provided for injecting ink droplets.

14 Claims, 3 Drawing Sheets

METHOD FOR FABRICATING AN INTEGRATED NOZZLE PLATE AND MULTI-LEVEL MICRO-FLUIDIC DEVICES FABRICATED

FIELD OF THE INVENTION

The present invention generally relates to a method for fabricating an integrated nozzle plate and multi-level micro-fluidic devices fabricated, more particularly, relates to a method for fabricating an integrated nozzle plate which functions as a micro-droplet generator that incorporates a light-absorbing layer for protecting a thick photoresist layer from over heating during the metal seed layer deposition process or the over-exposure of a second thick photoresist deposited thereon.

BACKGROUND OF THE INVENTION

Since the advent of printers, and specifically for low cost printers for personal computers, a variety of inkjet printing mechanisms have been developed and utilized in the industry. These inkjet printing mechanisms include the piezoelectric type, the electrostatic type and the thermal bubble type, etc. After the first thermal inkjet printer becomes commercially available in the early 1980's, there has been a great progress in the development of inkjet printing technology.

In an inkjet printer, a liquid droplet injector is one of the key mechanisms. To provide a high-quality and reliable inkjet printer, the availability of a liquid droplet injector capable of supplying high-quality droplets at high-frequency and high-spacial resolution is critical.

Presently, there are two types of inkjet printers that are available in the marketplace, the piezoelectric type and the thermal type. The thermal inkjet system, also known as thermal bubble inkjet system, as thermally driven bubble system or as bubble jet system utilizes bubble to eject ink droplets out of an ink supply chamber, while piezoelectric printers utilize piezoelectric actuators to pump ink out from a reservoir chamber. The principle of operation for a thermal bubble inkjet system is that an electrical current is first conducted to the heater by an electrode to boil liquid in an ink reservoir chamber. When the liquid is in a boiling state, bubble forms in the liquid and expands and thus functions as a pump to eject a fixed quantity of liquid from the reservoir chamber through an orifice and then forms into droplets. When the electrical current is turned-off, the bubble generated collapses and liquid refills the chamber by capillary force.

When evaluating the performance of a thermal bubble inkjet system, factors such as droplet ejection frequency, cross-talk between adjacent chambers and the generation of satellite droplets are considered. Two of these performance factors, i.e. the satellite droplets, which degrade the sharpness of the image produced and the cross-talk between adjacent chambers and flow channels which decreases the quality and reliability of the inkjet system are frequently encountered. In order to improve the performance of a thermal bubble inkjet system, these drawbacks must be corrected overcome.

In a copending application, Attorney Docket No. 64600-090, assigned to the common assignee of the present application which is hereby incorporated in its entirety, a thermal bubble type inkjet head that is equipped with a rapid ink refill mechanism and an off-shooter heater and a method for fabricating the head are disclosed. While the thermal bubble type inkjet head provides greatly improved results over the conventional thermal type inkjet head, the fabrication process for the head has been problematic due to overheating occurring in during the sputtering process of the metal seed layer or over-exposure of a second thick photoresist on top of the first thick photoresist layer. The overheating or over-exposure of the first thick photoresist layer affects the developing process of the layer.

It is therefore an object of the present invention to provide a micro-droplet generator, particularly related to micro-fluidic head that does not have the drawbacks or the shortcomings of the conventional thermal bubble injection head.

It is another object of the present invention to provide a micro-fluidic injection head that is equipped with a light-absorbing layer in between two photoresist layers for preventing overheating and over-exposure of the photoresist layers.

It is a further object of the present invention to provide a method for fabricating a micro-fluidic injection head that utilizes a symmetrical off-shooter heater to generate liquid droplets.

It is another further object of the present invention to provide a micro-fluidic injection head that is equipped with a liquid reservoir chamber.

It is yet another object of the present invention to provide a method for fabricating a micro-fluidic injection head that is equipped with a symmetrical heater.

It is still another further object of the present invention to provide a method for fabricating a micro-fluidic injection head that is equipped with a symmetrical heater utilizing two separate thick photoresist deposition processes and a nickel-containing material electroplating process.

SUMMARY OF THE INVENTION

In accordance with the present invention, a method for fabricating an integrated nozzle plate by depositing two photoresist layers of large thickness and a light-absorbing layer thereinbetween and a multi-level micro-fluidic injection device are disclosed.

In a preferred embodiment, a method for fabricating an integrated nozzle plate by depositing two photoresist layers of large thickness and a light-absorbing layer thereinbetween can be carried out by the operating steps of providing a silicon substrate that has a top surface and a bottom surface; forming a first and a second insulating material layer of at least 1000 Å thick on the top and bottom surfaces; reactive ion etching an opening for a manifold in the two insulating material layers on the bottom surface; wet etching a funnel-shaped manifold in the silicon substrate; forming a heater on the two insulating material layers on the top surface; depositing and patterning an interconnect with a conductive metal in electrical communication with the heater; depositing a third insulating material layer which may consist of two materials on top of the heater and the first insulating material layer; spin-coating a first photoresist layer of at least 1 $\mu$m thick on top of the third insulating material layer; patterning by UV exposure a liquid reservoir chamber in the first photoresist layer; depositing a metal seed layer on the first photoresist layer and patterning an injection orifice in the metal seed layer; spin-coating a second photoresist layer of at least 1 $\mu$m thick on the metal seed layer and patterning the injection orifice; removing the developed second photoresist layer except on top of the injection orifice; electroplating nickel on top of the metal seed layer encapsulating the second photoresist layer on top of the injection orifice; stripping away the second photoresist layer on top of the injection orifice; reactive ion etching from the backside away the first two insulating material layers on the top surface of the silicon substrate and the third insulating material layer exposed in the manifold; and stripping away the first photoresist layer from the liquid reservoir chamber.

The method for fabricating an integrated nozzle plate by depositing two photoresist layers of large thickness and a light-absorbing layer therein-between may further include the step of forming the first and the second photoresist layer by a material selected from the group consisting of epoxy, polyimide, novalac and acrylate based resins. The method may further include the step of wet etching a funnel-shaped manifold in the silicon substrate by KOH. The method may further include the step of depositing the light-absorbing photoresist layer by spin coating a photoresist solution that contains a black pigment, or the step of depositing the light-absorbing layer to a thickness of at least 0.5 $\mu$m.

The method may further include the step of spin-coating a first photoresist layer preferably of at least 1 $\mu$m thick, or the step of depositing the metal seed layer of Cr and Ni, or the step of stripping away the second photoresist layer by a wet etching method, or the step of stripping away the first photoresist layer from the liquid reservoir injection chamber by a wet etching technique, or the step of patterning the injection orifice in the metal seed layer.

The present invention is further directed to a multi-level micro-fluidic device that is equipped with a symmetrical heater which includes a silicon substrate that has a top surface and a bottom surface; a first and a second insulating material layer of at least 1000 Å thick on the top and bottom surfaces; a funnel-shaped manifold formed in the second insulating material layer and the silicon substrate; a heater formed on the first insulating material layer on the top surface; an interconnect formed of a conductive metal in electrical communication with the heater; a third insulating material layer on top of the heater and the first insulating material layer; a first photoresist layer of at least 2000 Å thick on top of the third insulating material layer; a light-absorbing layer on top of the first photoresist layer; a liquid reservoir chamber formed in the first photoresist layer in fluid communication with the funnel-shaped manifold; a metal seed layer on top of the light-absorbing layer; an injection orifice formed in the metal seed layer; and a Ni layer on top of the metal seed layer with an aperture formed therein in fluid communication with the injection orifice.

In the multi-level micro-fluidic device that is equipped with a symmetrical heater, the first photoresist layer preferably has a thickness of at least 1 $\mu$m, the light-absorbing layer is formed of a photoresist material that contains black pigment or an organic polymer; the light-absorbing layer may be formed to a thickness of at least 0.5 $\mu$m; the first and second insulating material layers may be a $SiO_2$ layer or a $Si_3N_4$ layer; the first and second photoresist layers may be formed of a material selected from the group consisting of epoxy, polyimide, novalac and acrylate based resins. The heater may be formed of TaAl, the metal seed layer may be deposited of Cr or Ni. The ring-shaped symmetrical heater may be positioned in the liquid reservoir chamber. The injection orifice may be formed in the liquid reservoir chamber opposite to the ring-shaped symmetrical heater. The injection head may be a monolithic head.

BRIEF DESCRIPTION OF THE DRAWINGS

These and other objects, features and advantages of the present invention will become apparent from the following detailed description and the appended drawings in which.

DETAILED DESCRIPTION OF THE PREFERRED AND ALTERNATE EMBODIMENTS

The present invention discloses a method for fabricating an integrated nozzle plate by depositing two thick photoresist layers with a light absorbing layer in between and a multi-level micro-fluidic device equipped with a symmetrical heater.

In the present invention method, two separate thick photoresist deposition processes by spin-coating with a light-absorbing layer deposited in between, and a nickel electroplating process are incorporated for achieving the final structure. The first thick photoresist spin-coating process is used for forming the liquid storage chamber. The light-absorbing layer is deposited to prevent overheating of the first photoresist layer during a subsequent metal seed layer deposition process, and to prevent the over-exposure of the second photoresist layer. The second thick photoresist spin-coating process is used to form a mold layer for forming a liquid orifice. The nickel-containing material electroplating process is used to form a top plate on the micro-fluidic head through which an injector orifice is formed. None of these novel processing steps is used in conventional fluidic head formation methods.

The present invention multi-level micro-fluidic device has a construction of the monolithic type formed on a silicon single crystal substrate. A ring-shaped heater electrode is formed in a symmetrical manner for superior liquid droplet generation. The ring-shaped heater electrode is further formed with a highly directional perpendicularity. With the present invention symmetrically constructed ring-shaped heater electrode, the problems of satellite droplets and interferences between adjacent orifices and flow channels can be minimized. A droplet is produced by the bubbles generated by the heater electrode. The various benefits and advantages described above are achieved by the present invention symmetrical ring-shaped heater electrode which can be arranged either in a off-shooter arrangement or in a back-shooter arrangement. The term "off shooter" means the position of the heater off shifted the position of the nozzle from the normal direction. An off-shooter arrangement process flow is described below, while the process flow for a back-shooter arrangement can be similarly executed with minor modifications.

Figure 1A:
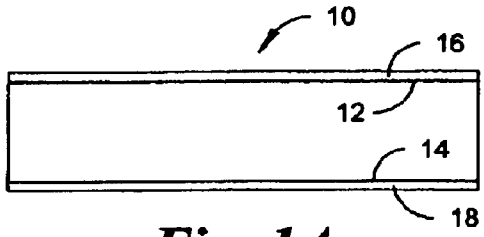
FIG. 1A is an enlarged, cross-sectional view of a present invention silicon substrate coated with an insulating material layer on a top surface and a bottom surface.

Referring initially to FIG. 1A, wherein a silicon substrate 10 used for constructing the present invention micro-fluidic device is shown. On a top surface 12 of the silicon substrate, and on a bottom surface 14 of the same, is then deposited by a low pressure chemical vapor deposition method insulating material layers 16 and 18, respectively. The insulating material layers 16, 18 can be formed of either $SiO_2$ or $Si_3N_4$ to a thickness of about 1000 Å, and preferably to about 2000 Å. In the preferred embodiment, a P-type 100 mm diameter silicon wafer that has a crystal orientation of (100) is utilized. A RCA cleaning procedure is first used to clean the wafer prior to processing. The $SiO_2$ layer may also be formed by a wet oxidation method in a furnace tube to a thickness larger than 1 $\mu$m.

Figure 1B:
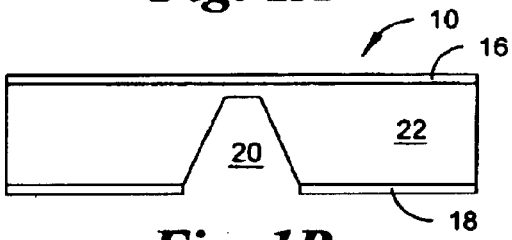
FIG. 1B is an enlarged, cross-sectional view of the present invention silicon substrate of FIG. 1A with an opening dry etched in the bottom insulating layer and a funnel-shaped manifold wet etched in the silicon substrate.
Figure 1B:
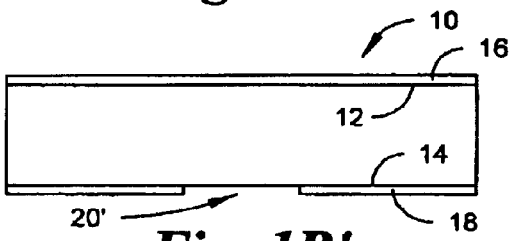

A first mask is then used, as shown in FIG. 1B, in a photolithographic process to define the position of manifold 20 and forming the manifold 20 by first dry etching the $SiO_2$ layer 18 by a reactive ion etching technique to form an opening 20' in the $SiO_2$ layer 18, as shown in FIG. 1B', and then etching the silicon layer 22 by a wet etching process utilizing a KOH or TMAH solution. The process is completed by rinsing the wafer with DI (deionized) water.

Figure 1C:
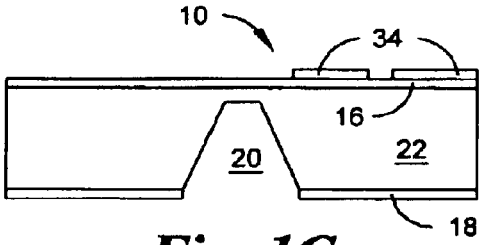
FIG. 1C is an enlarged, cross-sectional view of the present invention silicon substrate of FIG. 1B with a metal layer deposited on top and formed into an interconnect.
Figure 1D:
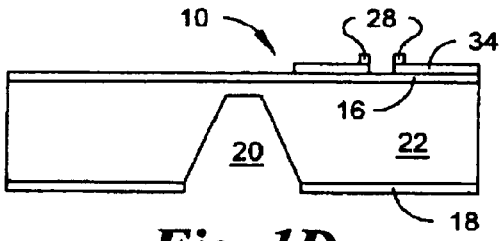
FIG. 1D is an enlarged, cross-sectional view of the present invention silicon substrate of FIG. 1C with a heater connected to an interconnect.

In the next step of the process, shown in FIG. 1C, an interconnection layer 34 including two interconnects spaced apart from each other is formed, by first depositing a metal layer on top of the insulating material layer 16 and then photolithographically patterning the metal layer. A second photomask is used for the interconnection forming process. A third mask is then used in a photolithographic process to define the locations of heater electrodes 28. A metal/alloy layer such as TaAl alloy is evaporated over the insulating material layer 16 and the interconnection layer 34 and patterned into the heater electrodes 28. The process is again completed with a DI water rinsing of the silicon wafer.

Figure 1E:
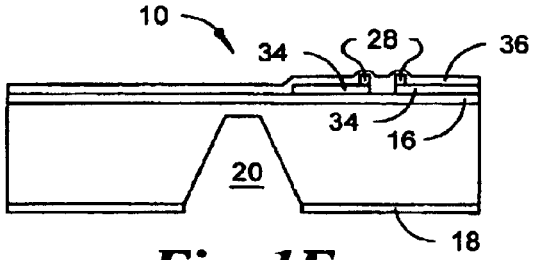
FIG. 1E is an enlarged, cross-sectional view of the present invention silicon substrate of FIG. 1D with a passivation layer deposited on top of the substrate.

Following the heater-electrode forming process, shown in FIG. 1E, an insulating material layer, or a passivation layer 36, is deposited on top of the silicon substrate 10 to provide insulation to the various structures of the interconnection 34 and the heater electrodes 28. The passivation layer 36 is a protection layer which can be deposited of a material selected from Si.sub.3N.sub.4, SiC and SiO.sub.2 by a plasma enhanced chemical vapor deposition technique. This is shown in FIG. 1E.

Figure 1F:
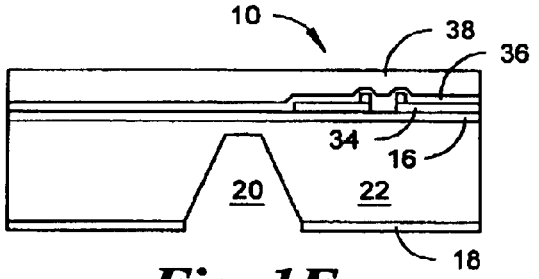
FIG. 1F is an enlarged, cross-sectional view of the present invention silicon substrate of FIG. 1E with a thick photoresist layer deposited on top.
Figure 1G:
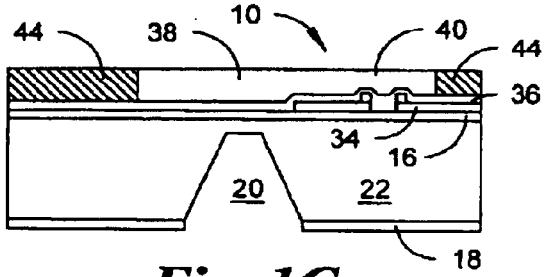
FIG. 1G is an enlarged, cross-sectional view of the present invention silicon substrate of FIG. 1F with a pattern formed in the photoresist layer by UV exposure.

The present invention novel method continues by the advantageous deposition step, shown in FIG. 1F, of a first thick photoresist layer 38 on top of the silicon substrate 10. The photoresist layer 38 should have a thickness of at least 1 $\mu$m, and preferably 10–35 $\mu$m deposited by a spin-coating technique and then baked for drying. An exposure process utilizing UV radiation, shown in FIG. 1G, follows by using a fourth photomask to define the size and location of the liquid reservoir 40. A developing step is not executed at this stage such that all the photoresist layers 38, either the exposed portion 44 or the unexposed portion, stay on top of the silicon substrate 10. This is a critical step of the present invention and must be patterned with great accuracy such that the location of the liquid reservoir chamber 40 can be determined.

Figure 1H:
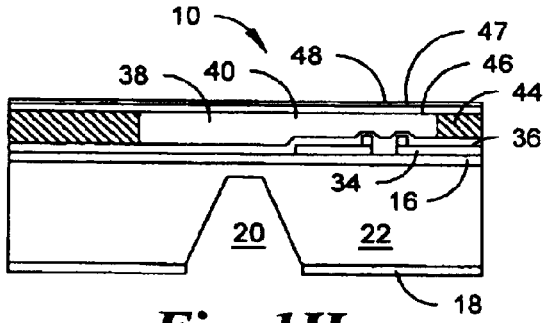
FIG. 1H is an enlarged, cross-sectional view of the present invention silicon substrate of FIG. 1G with a light-absorbing layer deposited and patterned on top for the micro-fluidic orifice.

In the next step of the process, shown in FIG. 1H, a light-absorbing layer 46 is deposited on top of the photoresist layer 38, 44 followed by the deposition of a metal seed layer 47. The layers 46, 47 are then patterned to define an injection orifice 48. The light-absorbing layer 46 may be deposited of a photoresist material to a thickness of at least 0.5 $\mu$m. For instance, the light-absorbing layer may be formed of an organic polymer or a black pigmented solution, i.e., a composition of PGMEA [CH3COOCH(CH3) CH2OCH3]+EEP(C2H5OCOCH2CH2OC2H5)+Cyclo heanone (C6H100)+Methacryl resin+multi functional acrylic monomer+pigments, etc. The purpose of the light-absorbing layer 46 is to prevent possible overheating of the first photoresist layer 38, 40, 44 during the metal seed layer 47 deposition process. The light-absorbing layer 46 further prevents the over-exposure of the second photoresist layer 50 (shown in FIG. 1I) that is subsequently deposited on top of the metal seed layer 47.

The metal seed layer may be deposited of a Cr/Ni alloy by sputtering or evaporation and is used as a seed layer for a subsequent electroplating process. A fifth photomask is used in a photolithography process to define the size and location of the injection orifice 48. The injection orifice 48 is formed by a wet etching technique followed by a process for removing the photoresist layer used in the lithography process.

Figure 1I:
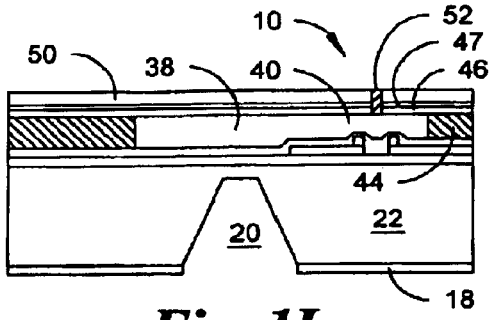
FIG. 1I is an enlarged, cross-sectional view of the present invention silicon substrate of FIG. 1H with a metal seed layer and a second thick photoresist layer spin-coated on top and patterned.

The present invention novel method is followed, as shown in FIG. 1I, by the deposition of a second thick photoresist layer 50 on top of the metal seed layer 47. The deposition can be carried out by a spin-coating technique and the photoresist layer 50 is patterned for the injection passage 52. The process is then followed by a photoresist developing process, during which the photoresist layer 50 is removed except at the injection passage 52, which stays on top of the injection orifice 48. This is shown in FIG. 1J.

Figure 1M:
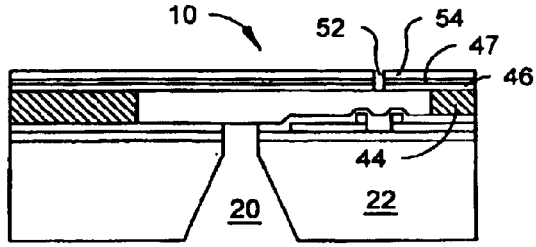
FIG. 1M is an enlarged, cross-sectional view of the present invention silicon substrate of FIG. 1L with the bottom insulating layer, the top insulating layer and the passivation layer stripped by dry etching.
Figure 1J:
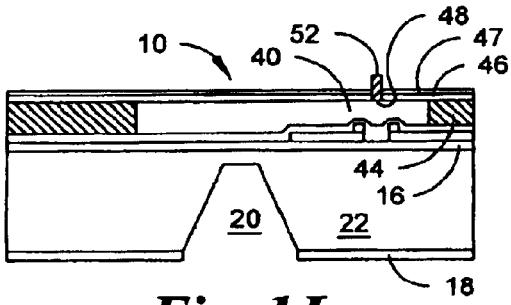
FIG. 1J is an enlarged, cross-sectional view of the present invention silicon substrate of FIG. 1I with the second photoresist layer developed.
Figure 1N:
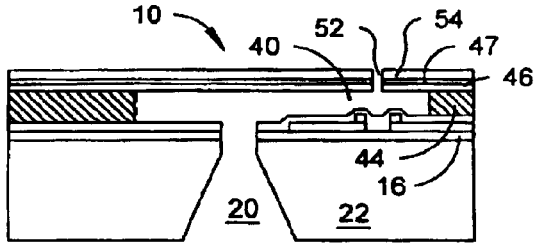
FIG. 1N is an enlarged, cross-sectional view of the present invention silicon substrate of FIG. 1M with the first photoresist layer stripped to form an ink chamber.
Figure 1K:
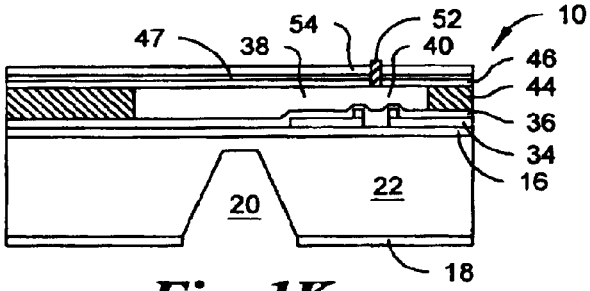
FIG. 1K is an enlarged, cross-sectional view of the present invention silicon substrate of FIG. 1J with an orifice plate electroplated on top.
Figure 1L:
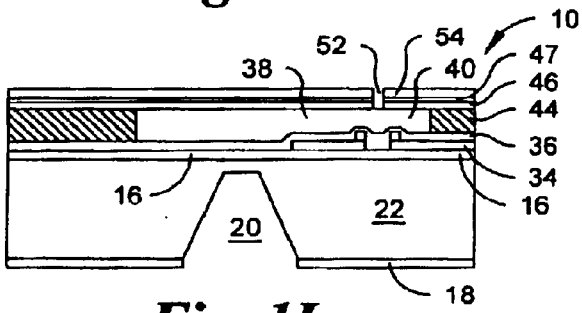
FIG. 1L is an enlarged, cross-sectional view of the present invention silicon substrate of FIG. 1K with the remaining second photoresist layer stripped to form the orifice.

An orifice plate 54 is then formed by a nickel electroplating process, as shown in FIG. 1K. The residual, second thick photoresist layer 50 in the injection passage 52 is then removed to form the injection passage in fluid communication with the liquid reservoir chamber 40, as shown in FIG. 1L. The photoresist removal process is performed by a wet etching technique.

The backside of the silicon substrate 10 is then etched by a reactive ion etching technique to remove the bottom insulating material layer 18, as shown in FIG. 1M, and the top insulating material layer 16 exposed in the manifold 20.

In the final step of the process, as shown in FIG. 1N, the first thick photoresist layer 38 is removed by a developing solution to vacate the liquid reservoir chamber 40 in fluid communication with the manifold 20 and the injection passage 52. The present invention novel multi-level micro-fluidic device that is equipped with a symmetrical ring-shaped heater is thus completed.

Figure 2:
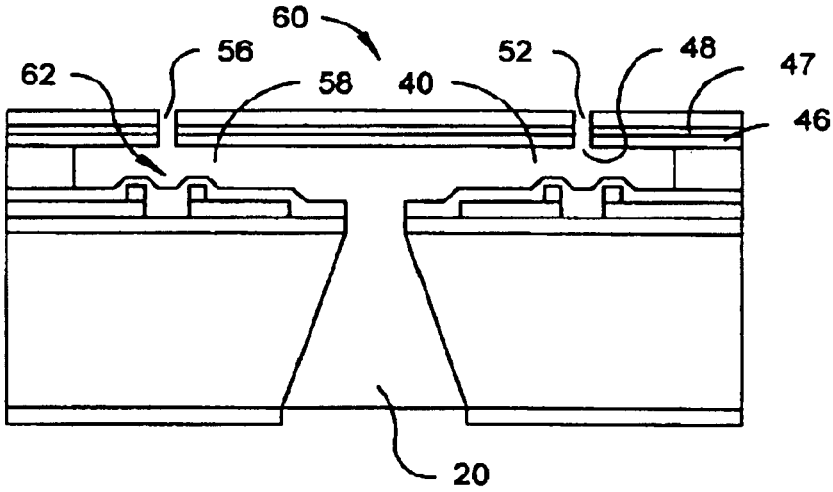
FIG. 2 is a enlarged, cross-sectional view of a second embodiment of the present invention micro-fluidic head equipped with two liquid orifices for two symmetrical off-shooter heaters.

In a second preferred embodiment of the present invention, as shown in FIG. 2, a multi-level micro-fluidic head 60 is provided which includes, in addition to the first injection passage 52 and the first injection orifice 48, a second injection passage 56 which is formed in a symmetrical manner to the first injection passage 52. Instead of the first preferred embodiment, the second preferred embodiment is provided with two liquid reservoir chambers 40 and 58. The processing steps for forming the present invention second embodiment is similar to that shown for forming the first embodiment except that a second ring-shaped heater electrode 62 and a second injection passage 56 are formed.

The operation of the present invention multi-level micro-fluidic device having an off-shooter arrangement is similar to that described in a copending application, attorney's docket #64,600–090, which is hereby incorporated in its entirety by reference.

The present invention novel multi-level micro-fluidic device equipped with symmetrical heaters and a method for fabricating the head have therefore been amply described in the above description and in the appended drawings of FIGS. 1A-2.

While the present invention has been described in an illustrative manner, it should be understood that the terminology used is intended to be in a nature of words of description rather than of limitation.

Furthermore, while the present invention has been described in terms of a preferred and two alternate embodiments, it is to be appreciated that those skilled in the art will readily apply these teachings to other possible variations of the inventions.

The embodiment of the invention in which an exclusive property or privilege is claimed are defined as follows.

What is claimed is:

1. A method for fabricating an integrated nozzle plate by depositing two photoresist layers and a light-absorbing layer comprising the steps of:

providing a silicon substrate having a top surface and a bottom surface;

forming a first and a second insulating material layer on said top and bottom surfaces, respectively;

etching an opening for a manifold in said second insulating material layer on said bottom surface;

etching a manifold in said silicon substrate;

depositing a metal conductive layer on said first insulating material layer and patterning in the metal conductive layer two interconnects spaced apart from each other;

forming a heater electrode on each of said two interconnects, said heater electrodes being separated apart from each other and each being; in electrical communication with one of said two interconnects;

depositing a third insulating material layer on top of said two spaced-apart heaters electrodes and said first insulating material layer;

spin-coating a first photoresist layer on said third insulating material layer;

patterning by UV exposure a primary ink chamber in said first photoresist layer;

depositing a light-absorbing layer on said first photoresist layer;

depositing a metal seed layer on said light-absorbing layer and patterning an orifice in said metal seed layer;

spin-coating a second photoresist layer on said metal seed layer and patterning said orifice;

removing said second photoresist layer except an area on top of said orifice;

electroplating a metal material on top of said metal seed layer encapsulating said second photoresist layer on top of said orifice;

removing said second photoresist layer on top of said orifice;

etching away said second insulating material layer on said bottom surface of said silicon substrate;

etching said first insulating material layer and said third insulating material layer from said manifold to exposed said primary ink chamber; and removing said first photoresist layer in said primary ink chambers.

2. A method for fabricating an integrated nozzle plate by depositing two photoresist layers and a light-absorbing layer according to claim 1 further comprising the step of forming said first and second photoresist layers by a material selected from the group consisting of epoxy, polyimide, novalac and acrylate based resins.

3. A method for fabricating an integrated nozzle plate by depositing two photoresist layers and a light-absorbing layer according to claim 1 further comprising the step of depositing said light-absorbing layer by spin coating a photoresist solution that contains black pigment or an organic polymer.

4. A method for fabricating an integrated nozzle plate by depositing two photoresist layers and a light-absorbing layer according to claim 1 further comprising the step of depositing said light-absorbing layer to a thickness of at least 0.5 $\mu$m.

5. A method for fabricating an integrated nozzle plate by depositing two photoresist layers and a light-absorbing layer according to claim 1 further comprising the step of spin-coating a first photoresist layer to a thickness of at least 1 $\mu$m.

6. A method for fabricating an integrated nozzle plate by depositing two photoresist layers and a light-absorbing layer according to claim 1 further comprising the step of depositing said metal seed layer with Cr and Ni.

7. A method for fabricating an integrated nozzle plate by depositing two photoresist layers and a light-absorbing layer according to claim 1 further comprising the step of stripping away said second photoresist layer by a wet etching method.

8. A method for fabricating an integrated nozzle plate by depositing two photoresist layers and a light-absorbing layer according to claim 1 further comprising the step of stripping away said first photoresist layer.

9. A method for fabricating an integrated nozzle plate by depositing two photoresist layers and a light-absorbing layer according to claim 1 further comprising the step of patterning said orifice in said metal seed layer adjacent to said heater electrodes.

10. A method for fabricating an integrated nozzle plate by depositing two photoresist layers and a light-absorbing layer according to claim 1 further comprising the step of forming said first insulating material layer of at least 1000 Å thick on said top surface.

11. A method for fabricating an integrated nozzle plate by depositing two photoresist layers and a light-absorbing layer according to claim 1 further comprising the step of forming said second insulating material layer of at least 1000 Å thick on said bottom surface.

12. A method for fabricating an integrated nozzle plate by depositing two photoresist layers and a light-absorbing layer according to claim 1 further comprising the step of spin-coating said second photoresist layer of at least 1 $\mu$m thick on said metal seed layer.

13. A method for fabricating an integrated nozzle plate by depositing two photoresist layers and a light-absorbing layer according to claim 1 further comprising the step of etching said manifold in a funnel shape.

14. A method for fabricating an integrated nozzle plate by depositing two photoresist layers and a light-absorbing layer according to claim 1 further comprising the step of electroplating said metal material containing Ni on top of said metal seed layer.

* * * * *